United States Patent [19]

Okano

[11] Patent Number: 5,002,183

[45] Date of Patent: Mar. 26, 1991

[54] GARMENT BAG

[75] Inventor: Takayoshi Okano, Higashiosaka, Japan

[73] Assignee: Sumitomo Chemical Company, Limited, Osaka, Japan

[21] Appl. No.: 256,567

[22] Filed: Oct. 12, 1988

[30] Foreign Application Priority Data

Oct. 12, 1987 [JP] Japan ..... 62-1555980

[51] Int. Cl.[5] ..... B65D 85/18

[52] U.S. Cl. ..... 206/287

[58] Field of Search ..... 206/286, 279, 280, 287, 206/287.1

[56] References Cited

U.S. PATENT DOCUMENTS

| | | | |
|---|---|---|---|
| 393,712 | 11/1888 | Manahan | 206/287 |
| 952,181 | 3/1910 | Bornot | 206/286 X |
| 1,066,265 | 7/1913 | Freid | 206/287 |
| 1,119,986 | 12/1914 | Pleger et al. | 206/287 X |
| 1,133,018 | 3/1915 | Freid | 206/287 X |
| 1,200,030 | 10/1916 | Rottman | 206/287 X |
| 1,622,323 | 3/1927 | Kuik | 206/280 |
| 1,629,362 | 5/1927 | Robert | 206/287.1 X |
| 1,652,269 | 12/1927 | Bremner | 206/287 |
| 2,755,013 | 7/1956 | Beede | 206/287 |
| 3,559,777 | 2/1971 | Gardner | 206/279 |
| 4,733,984 | 3/1988 | Katsuda et al. | 401/190 |

*Primary Examiner*—Stephen Marcus
*Assistant Examiner*—Nova Stucker
*Attorney, Agent, or Firm*—Birch, Stewart, Kolasch & Birch

[57] ABSTRACT

A garment bag which comprises a gas-permeable surface sheet, a gas-impermeable back sheet joined thereto at their peripheries to make a compartment for accommodating a garment therein and an opening means provided on either one of said surface sheet and back sheet, for providing access into said compartment, and a gas-impermeable sheet being joined onto said gas-permeable surface sheet to make a pocket for accommodating a chemical therein.

5 Claims, 5 Drawing Sheets

FIG. 6
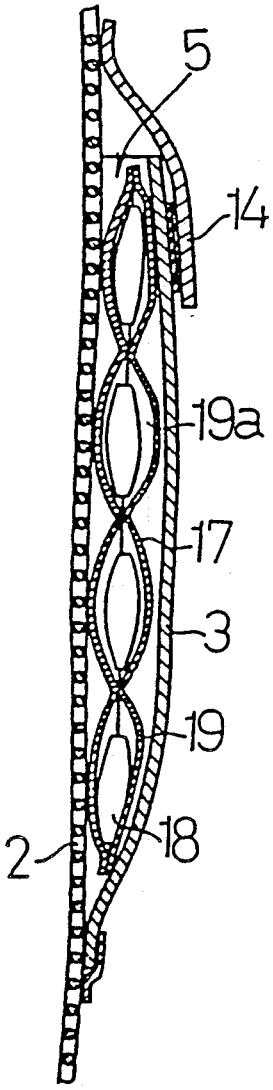
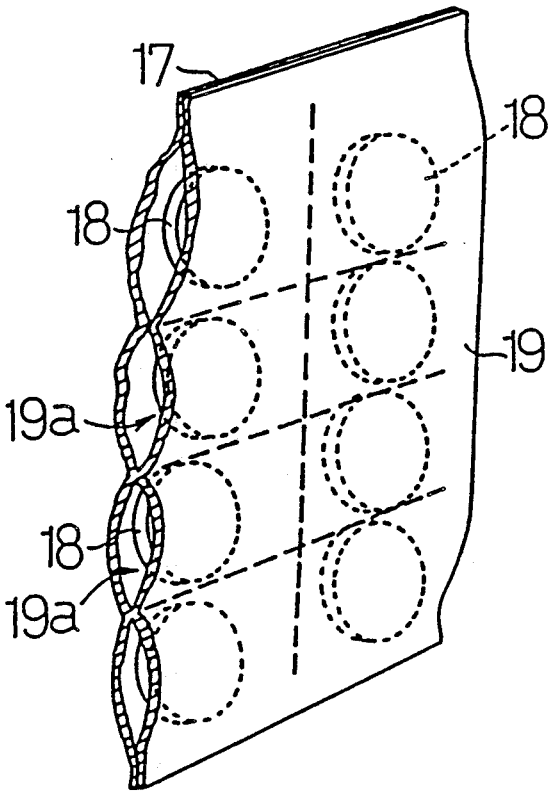
FIG. 7

GARMENT BAG

BACKGROUND AND SUMMARY OF THE INVENTION

The present invention relates to a garment bag. More particularly, it relates to a garment bag having a pocket for accommodating therein a chemical (e.g. an insecticide, a deodorant, a demoisturing agent, an anti-microbial agent), thereby effectively protecting a garment not only from attachment and accumulation of dusts but also from damages by public pests, offensive odors or moistures.

Conventional garment bags are normally kept in a closet, a suitcase or the like and usually function only to avoid dust from collecting on garments accommodated therein, although there are some garment bags having a number of pores at the surfaces for the purpose of ventilation. Protection of garments from other damage, for instance, by public pests, offensive odors or moistures is performed separately by placing in the closet, the suitcase or the like a suitable chemical such as an insecticide, a deodorant or a demoisturing agent, usually packaged in a container. Even if an attempt is made to provide a conventional garment bag with a chemical, a troublesome operation is required for its provision and difficulties are encountered on determination of an appropriate location for the provision. Further, the use of a garment bag in a closet, a suitcase or the like rather decreases the preventive effect of a chemical.

A major object of the present invention is to provide an improved garment bag having a pocket for accommodating therein a chemical in a state easy for handling and in a manner assuring exertion of the preventive effect which the chemicals such as an insecticide, a deodorant, a demoisturing agent and an anti-microbial agent exhibit.

The garment bag of the present invention comprises a gas-permeable surface sheet, a gas-impermeable back sheet joined thereto at their peripheries, an opening provided on either one of said surface and back sheets to provide access to the garment bag and a gas-impermeable sheet joined to said surface sheet at the periphery to make a pocket for accommodating a chemical therein.

In the above structure, the surface sheet may be made of any gas-permeable material such as cloth, nonwoven fabric or Japanese paper. The back sheet may be made of any gas-impermeable material such as synthetic elastic resin or a laminated product thereof. A laminated product of a synthetic soft resin sheet with a gas-permeable sheet (e.g. cloth, nonwoven fabric, Japanese paper) may be also used to make the back sheet. The locus and number of the pocket are not limited as far as it stands on the surface sheet. As the material for the pocket, there is preferably used any transparent or semi-transparent sheet made of polyvinyl chloride, polyester, ethylene/vinyl acetate copolymer, polyethylene, polypropylene or the like. A laminated product of such transparent or semi-transparent sheet is also usable. The chemical may be as such accommodated in the pocket when it is in a shaped form having a considerable size. Preferably, however, the chemical is admitted in a flat disposable container, and the container is accommodated in the pocket. The term "container" is herein used in a broad sense and may be any one which can retain therein a chemical in a solid or liquid state. A typical example of the container in the simplest form is a nonwoven fabric, which may be impregnated with a vaporizable chemical. Another example is a bag made of Japanese paper, wherein a solid chemical may be admitted.

According to the present invention, the surface sheet and the back sheet are joined at their peripheries to make a bag in which the ventilation of air is accomplished through the surface sheet which is gas-permeable. The surface sheet functions also as the inner sheet for the pocket, and the chemical in the pocket is diffused through such surface sheet into the bag to exert its preventive effect on the garment in the bag. Since the back sheet is gas-imperpeable, the inside of the bag is not forcedly influenced by the outer air so that the preventive effect of the chemical is efficiently exerted. Due to the flat shape of the container, the surface of the bag can also be kept substantially flat and retain the chemical in a stable state. The outer sheet of the pocket is made of a transparent or semi-transparent material so that the chemical or the container accommodated in the pocket can be visually observed from the outside. It is particularly preferred that the container is provided with a function indicating the existence of the chemical so that the consumption of the chemical can be readily ascertained by visual observation.

The present invention will be hereinafter explained more in detail with reference to the accompanying drawings, in which:

FIG. 6 is a sectional view of an embodiment of the container for the chemical;

FIG. 7 is a perspective view of the container as shown in FIG. 6 and as partly cut away;

Figure 1:
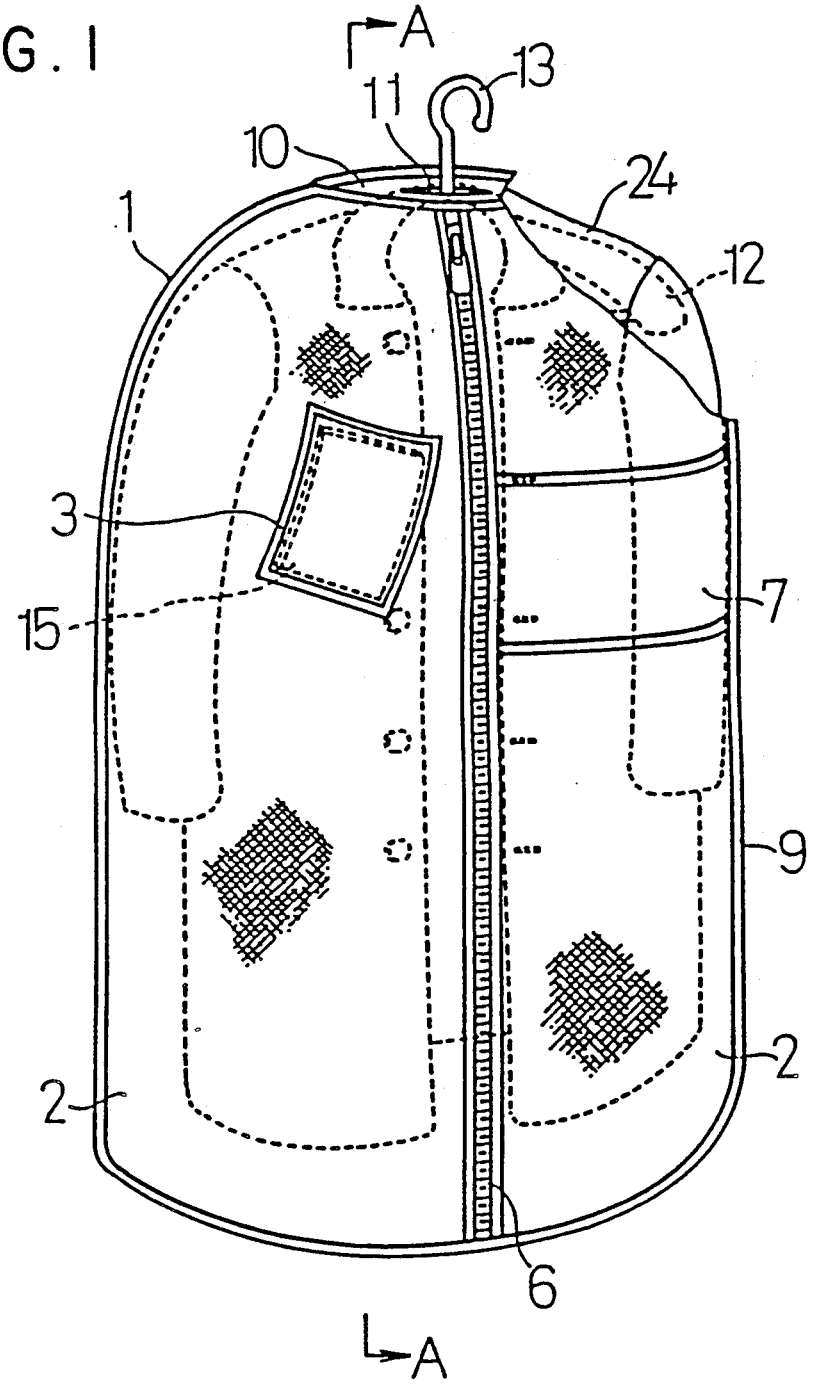
FIG. 1 is a perspective view of an embodiment of the garment bag according to the invention as partly cut away.
Figure 2:
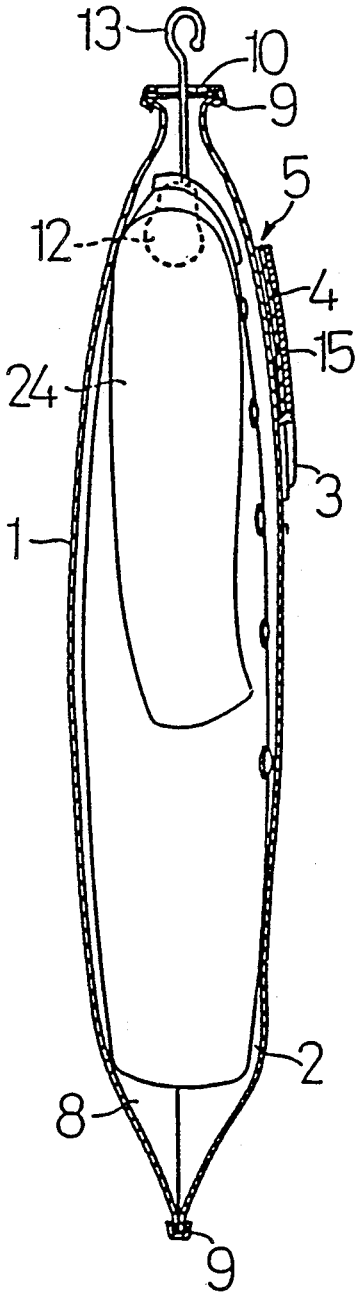
FIG. 2 is a sectional view of the garment bag taken along the line A—A in FIG. 1.
Figure 3:
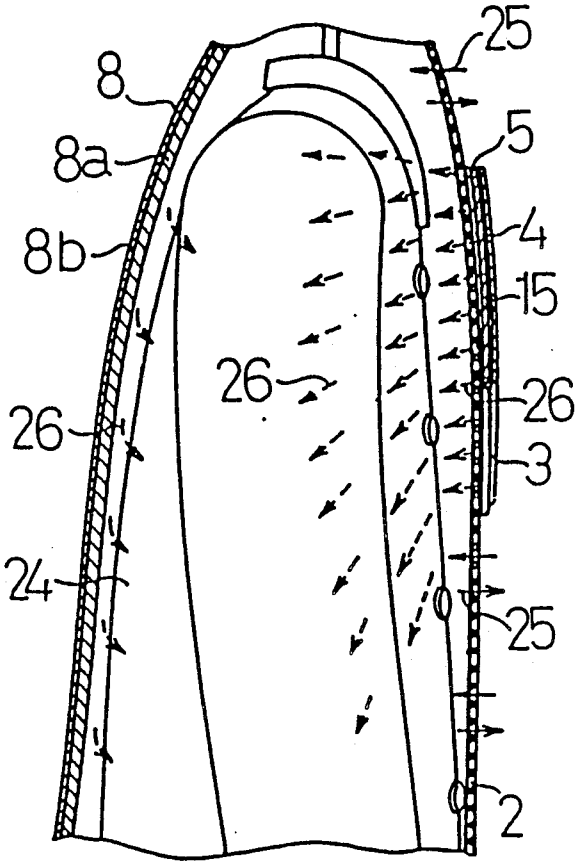
FIG. 3 is an enlarged sectional view of a part of the garment bag as shown in FIG. 1.

Referring to FIGS. 1 and 2, the garment bag 1 comprises the surface sheet 2 made of nonwoven fabric and the back sheet 8 made of polyethylene-laminated nonwoven fabric, the peripheries of said sheets 2 and 8 being joined and sewed by a hem tape 9. Onto the fairly upper part of the surface sheet 2, a transparent synthetic resin sheet (e.g. polyvinyl chloride sheet) is joined by sewing to make a pocket 3, of which all the peripheries except an upper opening 5 is joined to the surface sheet 2. A fastener 6 extends downwardly at the center of the surface sheet 2. On the opposite side to the pocket, there is a patched window 7 made of a transparent synthetic resin sheet for seeing the inside of the bag through the sheet. The top portion of the garment bag 1 is designed to have a gusset 10 having a hole 11 at the center, through which a hook 13 of a hanger 12 can extend. The garment 24 which is inserted into the garment bag 1 by releasing the fastener 6 can be hung on the hanger 12. Into the pocket 3, a non-woven fabric base sheet 15 is inserted along the surface sheet 2, the base sheet being impregnated, for instance, with a vaporiable insecticide which vaporizes at ordinary temperature. As shown in FIG. 3, air 25 flows into the garment bag 1 through the surface sheet 2. At the same time, a gas 26 vaporized from the chemical impregnated in the base sheet 15 also enters into the garment bag 1 via the surface sheet 2 and spontaneously spreads around the garments 24 for exerting its insecticidal activity.

EXPERIMENT

A nonwoven fabric (15×10 cm) as the base sheet 15 was impregnated with a commercial insecticide, i.e. (RS)-1-ethynyl-2-methyl-2-pentenyl (1R)-cis,trans-chrysantemate (chemical name: empenthrin) having the following formula:

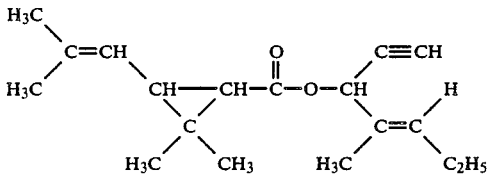

and inserted into the pocket 3. Separately, a woven cloth (3.5×3.5 cm; wool, 100%) and 20 larvae of common clothes moth (*Tineola bisselliellao* Hummel) (20 days old) or black carpet beetle (*Attagenus Japonicus* Reitter) (60 days old) were released into each plastic container (4×5×3.5 cm) covered with nets at the upper and lower openings, and three of such container were hung down in the garment bag 1 respectively at the three loci corresponding to the shoulder portion (upper), the waist portion (middle) and the dress hem (bottom) of the garment 24. The thus arranged garment bag 1 was kept at 27° C. under 60% humidity for 2 weeks. Then, the insecticidal activity was observed. The results are shown in Table 1. After said two week term, the same test as above was again perfomred on the same garment bag as used above, of which the result are shown in Table 2. In these Tables, the rate of feeding damage and the efficacy index were respectively calculated according to the following equations:

Rate of feeding damage (%)=[(the weight of test cloth (g) prior to testing−the weight of test cloth (g) after testing)/the weight of test cloth (g) prior to testing]×100;

Efficacy index=[(the damaged weight of test cloth (g) in untreated plot−the damaged weight of test cloth (g) in treated plot)/the damaged weight of test cloth (g) in untreated plot]×100

TABLE 1

| | | Common clothes moth | | | Black carpet beetle | | |
|---|---|---|---|---|---|---|---|
| Dosage (mg) | Location | Amount of damaged cloth (g) | Rate of feeding damage (%) | Efficacy index | Amount of damaged cloth (g) | Rate of feeding damage (%) | Efficacy index |
| 100 | Upper | 0.0398 | 33.6 | 56.7 | 0.0588 | 40.0 | 43.7 |
| | Middle | 0.0279 | 20.8 | 69.7 | 0.0577 | 41.3 | 44.8 |
| | Bottom | 0.0140 | 11.6 | 84.8 | 0.0425 | 35.8 | 59.3 |
| 200 | Upper | 0.0324 | 26.3 | 64.8 | 0.0349 | 25.6 | 66.6 |
| | Middle | 0.0300 | 25.7 | 67.4 | 0.0357 | 26.3 | 65.8 |
| | Bottom | 0.0164 | 7.8 | 82.2 | 0.0308 | 25.9 | 70.5 |
| 300 | Upper | 0.0279 | 20.8 | 69.7 | 0.0278 | 29.8 | 73.4 |
| | Middle | 0.0151 | 12.7 | 83.6 | 0.0352 | 25.7 | 66.3 |
| | Bottom | 0.0117 | 9.1 | 87.3 | 0.0329 | 27.4 | 68.5 |
| Untreated | — | 0.0920 | 77.6 | — | 0.1045 | 76.3 | — |

TABLE 2

| | | Common clothes moth | | | Black carpet beetle | | |
|---|---|---|---|---|---|---|---|
| Dosage (mg) | Location | Amount of damaged cloth (g) | Rate of feeding damage (%) | Efficacy index | Amount of damaged cloth (g) | Rate of feeding damage (%) | Efficacy index |
| 100 | Upper | 0.0136 | 11.8 | 89.5 | 0.0415 | 33.5 | 63.2 |
| | Middle | 0.0187 | 15.2 | 85.6 | 0.0316 | 26.7 | 72.0 |
| | Bottom | 0.0022 | 1.8 | 98.3 | 0.0105 | 9.8 | 90.7 |
| 200 | Upper | 0.0593 | 47.1 | 54.3 | 0.0375 | 33.8 | 66.8 |
| | Middle | 0.0133 | 10.7 | 89.8 | 0.0125 | 10.2 | 88.9 |
| | Bottom | 0.0032 | 2.6 | 97.5 | 0.0072 | 7.5 | 93.6 |
| 300 | Upper | 0.0251 | 20.2 | 80.7 | 0.0058 | 5.9 | 94.9 |
| | Middle | 0.0046 | 3.7 | 96.5 | 0.0019 | 1.6 | 98.3 |
| | Bottom | 0 | 0 | 100.0 | 0.0025 | 1.8 | 97.8 |
| Untreated | — | 0.1299 | 100 | — | 0.1128 | 92.3 | — |

It is understood from the above results that the garment bag according to the present invention exhibits a high anti-insecticidal efficacy over a long period of time.

Figure 4:
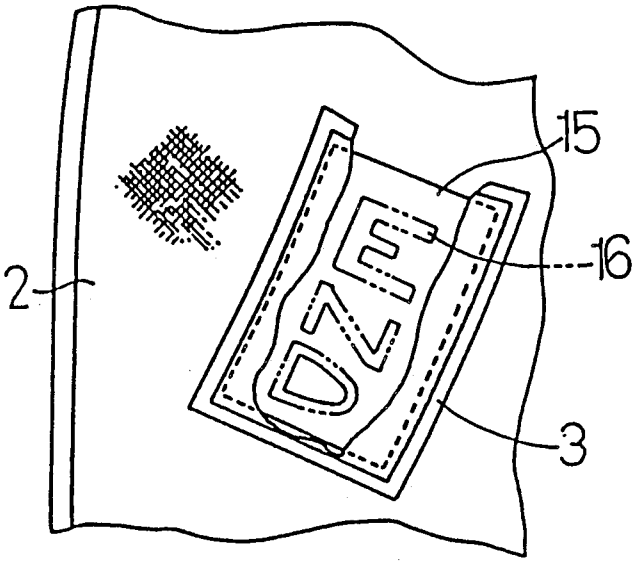
FIG. 4 is an enlarged plan view of a part of the garment bag as shown in FIG. 1 as partly cut away.

When the outer sheet 4 of the pocket 3 is made with a transparent or semi-transparent material such as polyvinyl chloride or polyethylene and the base sheet 15 is, as shown in FIG. 4, provided with a function-indicating part 16 sensitive to the existence of the chemical, the consumption of the chemical can be readily ascertained by visual observation. For this purpose, the pocket is favored to be located at a position which is attractive to visual observation.

Figure 5:
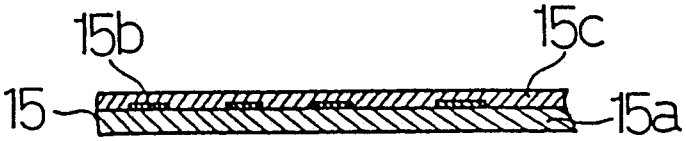
FIG. 5 is a sectional view of the chemical-impregnated sheet as shown in FIG. 4.

A typical example of the container is the base sheet 15 provided with a function-indicating part 16 as shown in FIG. 5. Namely, it comprises a base paper sheet 15*a*, an oil-impermeable acrylic resin or polypropylene pattern layer 15*b* on one side of said sheet 15*a* and a coating layer 15*c* comprising a mixture of a coloring agent (e.g. amorphous silica) and a binder (e.g. polyvinyl acetate) and covering the pattern layer 15*b*. Depending on the vaporization amount of the chemical, the pattern appearing at the surface of the sheet 15 changes so that the existence or remainder of the chemical can be readily ascertained by visual observation. Other examples of the base sheet are disclosed, for instance, in Japanese Patent Publn. (unexamined) Nos. 224603/1985, 50901/1986, 72701/1986 and 152601/1986.

Another example of the container is shown in FIGS. 6 and 7. The air-permeable flat container 17 made of nonwoven fabric or Japanese paper is divided into several sections 19, each section having a compartment 19*a* into which a sublimating solid chemical 18 (e.g. naphthalene, camphor) is admitted. The container 17 in this fashion is inserted and fixed in the pocket 3 so that the preventive effect of the chemical can be efficiently exerted. When desired, a shut-off means 14 may be provided over the opening portion 5 of the pocket 3 as shown in FIG. 6.

Figure 8:
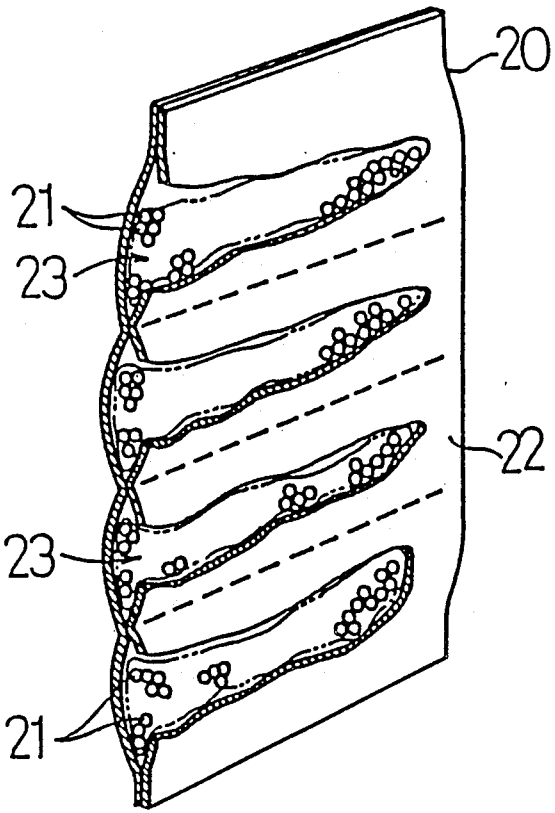
FIG. 8 is a perspective view of another embodiment of the container as party cut away.

A further example of the container is shown in FIG. 8. The air-permeable flat container 20 is divided into several sections 22 each having a compartment 23 containing the chemical in the form of granules or dusts. The container 20 is inserted into the pocket 3 for exertion of the preventive effect of the chemical.

Figure 9:
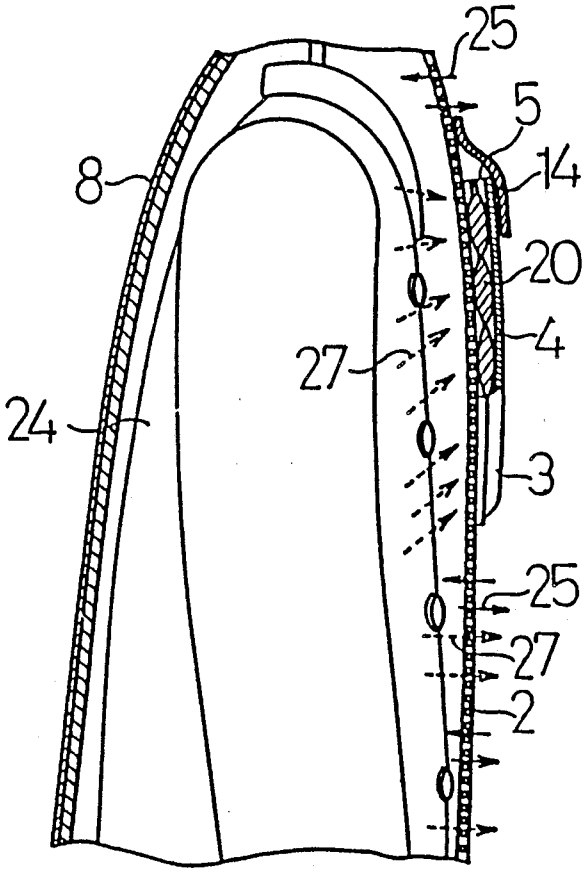
FIG. 9 is an enlarged sectional view of a part of the sectional view of another embodiment of the garment bag according to the invention.

In the case of using a demoisturing agent or a deodorant as the chemical, the garment bag 1 as shown in FIG. 9 permits the in-and-out flow of air 25 through the surface sheet 2, during which moisture or offensive odor 27 in the garment bag 1 is efficiently absorbed onto the chemical 21 in the container 20.

As explained above, the garment bag according to the present invention can be handled in substantially the same manner as conventional garment bags, yet it has a characteristic structure which can realize the efficient exertion of the preventive effect while permitting the in-and-out flow of air within the garment bag. It can be used particularly advantageously when accompanied with a base sheet having a function indicating the existence of the chemical therein, whereby the garment can be protected and preserved in a good and stable condition over a long period of time.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A garment bag which comprises a gas-permeable surface sheet and a gas-impermeable back sheet, said sheets being joined thereto at their peripheries to define a compartment for accommodating a garment therein, an opening means provided on either one of said surface sheet or said back sheet, for providing access into said compartment, and a gas-impermeable sheet being joined to said gas-permeable surface sheet to make a pocket for accommodating a chemical therein.

2. The garment bag according to claim 1, wherein the pocket is made of a transparent or semi-transparent material.

3. The garment bag according to claim 2, wherein the chemical is disposed in a container which in turn is accommodated in the pocket.

4. The garment bag according to claim 3, wherein the container is gas-permeable and flat.

5. The garment bag according to claim 3, wherein the chemical is empenthrin ((RS)-1-ethynyl-2-methyl-2-pentenyl (1R)-cis,trans,chrysantemate).

* * * * *